US012601338B2

(12) United States Patent
Sames et al.

(10) Patent No.: US 12,601,338 B2
(45) Date of Patent: Apr. 14, 2026

(54) RECIPROCATING PUMP WITH RESERVOIR FOR COLLECTING AND CONTROLLING WORKING FLUID LEVEL WITHOUT THE USE OF PISTON SEALS

(71) Applicant: Cinco Research Corporation, Elizabethton, TN (US)

(72) Inventors: William Sames, Johnson City, TN (US); Amos Manneschmidt, Knoxville, TN (US)

(73) Assignee: BRACKINS MACHINE SHOP, LLC, Erwin, TN (US)

( * ) Notice: Subject to any disclaimer, the term of this patent is extended or adjusted under 35 U.S.C. 154(b) by 261 days.

(21) Appl. No.: 18/322,791

(22) Filed: May 24, 2023

(65) Prior Publication Data

US 2024/0117803 A1 Apr. 11, 2024

Related U.S. Application Data

(60) Provisional application No. 63/378,535, filed on Oct. 6, 2022.

(51) Int. Cl.

| | |
|---|---|
| ***F04B 17/04*** | (2006.01) |
| ***F04B 19/22*** | (2006.01) |
| ***F04B 23/02*** | (2006.01) |
| ***F04B 49/03*** | (2006.01) |

(52) U.S. Cl.

CPC ..... *F04B 17/04* (2013.01); *F04B 19/22* (2013.01); *F04B 23/02* (2013.01); *F04B 49/03* (2013.01)

(58) Field of Classification Search

CPC ..... F04B 15/04; F04B 17/04; F04B 17/044; F04B 23/02; F04B 53/143; F04B 19/22; F04B 49/03

USPC ..... 92/83, 86, 86.5; 277/431, 432; 417/357, 417/366, 369, 370, 383, 384, 385

See application file for complete search history.

(56) References Cited

U.S. PATENT DOCUMENTS

| | | | | | |
|---|---|---|---|---|---|
| 2,330,781 | A | * | 9/1943 | Langmyhr | F04B 53/101 277/516 |
| 3,000,320 | A | * | 9/1961 | Ring | F04B 43/067 417/567 |
| 3,019,739 | A | * | 2/1962 | Prosser | F04B 53/14 277/513 |
| 3,216,365 | A | | 11/1965 | Urach | |
| 3,488,763 | A | * | 1/1970 | Lofquist, Jr. | F04B 1/02 92/99 |
| 3,547,005 | A | * | 12/1970 | Van der Aa Emmasingel | F02G 1/0535 91/416 |
| 3,740,171 | A | * | 6/1973 | Farkos | F04B 17/044 417/418 |
| 3,742,822 | A | * | 7/1973 | Talbert | F04B 53/164 92/168 |
| 4,102,610 | A | | 7/1978 | Lindsey | |

(Continued)

FOREIGN PATENT DOCUMENTS

| | | | |
|---|---|---|---|
| CN | 2668890 | | 1/2005 |
| CN | 2668890 | Y * | 1/2005 |

(Continued)

*Primary Examiner* — Alexander B Comley

(74) *Attorney, Agent, or Firm* — Robinson IP Law, PLLC

(57) ABSTRACT

A reciprocating pump with a reservoir for collecting and controlling a working fluid level without the use of piston seals. A method of collecting and controlling a working fluid level in a reciprocating pump which has no piston seals.

29 Claims, 8 Drawing Sheets

(56) References Cited

U.S. PATENT DOCUMENTS 4,174,929 A * 11/1979 Grakov ..... F16J 15/44 277/910
4,527,957 A * 7/1985 Dettinger ..... F04B 15/04 417/900
4,870,821 A * 10/1989 Harada ..... F02G 1/0535 60/520
4,920,863 A * 5/1990 Taga ..... F04B 53/141 417/437
4,991,495 A * 2/1991 Loegel, Sr. ..... F16J 15/56 92/153
5,403,169 A 4/1995 Yokoi et al.
5,558,506 A 9/1996 Simmons
6,510,781 B2 1/2003 Pecca et al.
7,134,851 B2 11/2006 Chenoweth
7,677,155 B2 * 3/2010 Marriott ..... F04B 1/0448 417/415
8,196,781 B2 6/2012 Greenwald et al.
8,920,136 B2 * 12/2014 Legros ..... H02K 5/128 417/357
9,103,307 B2 * 8/2015 Lingener ..... F02M 37/08
9,828,987 B2 11/2017 Steffen et al.
10,041,484 B2 8/2018 Steffen et al.
10,393,111 B2 8/2019 Stockner et al.
2004/0213690 A1 10/2004 Chenoweth
2006/0045782 A1 3/2006 Kretzinger et al.
2006/0127252 A1 6/2006 Caddell
2008/0193299 A1 * 8/2008 Oglesby ..... F04B 53/02 417/442
2009/0064857 A1 3/2009 Chenoweth
2010/0326271 A1 12/2010 Stang
2015/0204316 A1 * 7/2015 Smith ..... F04B 53/143 417/559
2017/0268491 A1 9/2017 Ho

FOREIGN PATENT DOCUMENTS

CN 102220971 10/2011
CN 202811251 3/2013
CN 103670996 3/2014
CN 103670996 A * 3/2014
CN 204692076 10/2015
CN 206681963 11/2017
CN 108533484 9/2018
CN 112302896 2/2021
EP 299431 A * 1/1989
EP 1975409 A2 * 10/2008 ..... F04B 15/04

* cited by examiner

RECIPROCATING PUMP WITH RESERVOIR FOR COLLECTING AND CONTROLLING WORKING FLUID LEVEL WITHOUT THE USE OF PISTON SEALS

STATEMENT AS TO INVENTION RIGHTS UNDER FEDERALLY SPONSORED RESEARCH

This invention was made with government support under Grant No. DE-SC0021764 awarded by the U.S. Department of Energy. The government has certain rights in the invention.

FIELD

This disclosure relates to the field of pumps. More particularly, this disclosure relates to reciprocating pumps for transferring fluids.

BACKGROUND

Pumps that utilize a piston to create positive displacement of a working fluid are a very old method of pumping liquids that has been in use since at least 250 BCE. Historically, such pumps have utilized seals to prevent the backflow or leakage of working fluid past the piston. Such pumps have typically been used for processing viscous fluids in applications such as paint, adhesive, and glaze production. The seals used in such pumps have typically been made of rubber, plastic, and other compliant materials and are replaceable in nature. Such pumps typically have operational temperature ranges that are therefore limited by the operational temperature(s) of such seals. Some applications require higher operating temperatures such as for example, the pumping of molten salt. Traditional piston pump seals, therefore, provide a significant operational limitation. Additionally, for lower temperature applications, the use of such seals and lubricating substances can introduce contaminants into a working fluid. The seals can degrade over time and/or the lubricant used can leach into the working fluid. This can be particularly problematic if the pump being used is for a hygienic application that requires a very high purity working fluid. Such applications may include, for example, food processing.

Ceramic pistons, compared to metal or metal alloy pistons, have a known wear resistance advantage and have a higher temperature operational ceiling in such types of pumps and are produced commercially, typically with a ceramic built around a metal shaft that can be connected to a driving mechanism. An example of such a pump is disclosed in U.S. Pat. No. 7,134,851 entitled "Reciprocating Pump Having a Ceramic Piston" to Chenoweth, the entire contents of which are incorporated herein by reference. The terms "reciprocating pump" and "piston pump" are used herein interchangeably to refer to positive displacement pumps that utilize a piston. Examples include pumps described in U.S. Patent Application Publication Number 2010/0326271 entitled "Reciprocating Pump And Method For Making A System With Enhanced Dynamic Seal Reliability" to Stang, U.S. Patent Application Publication Number 2006/0127252 entitled "Reciprocating Pump System" to Caddell, and U.S. Patent Application Publication Number 2006/0045782 entitled "Low-Friction Reciprocating Pump" to Kretzinger, and U.S. Pat. No. 5,403,169 entitled "Plunger Pump" to Yokoi, the entire contents of which are incorporated herein by reference. Although the ceramic components allow for high temperature operation, such pumps are still limited by the seals required to prevent leakage around a piston during operation. Some have tried moving seals far back from a front of a piston (e.g., U.S. Patent Application Publication Number 2006/0045782 entitled "Low-Friction Reciprocating Pump" to Kretzinger et al., the entire contents of which are incorporated herein by reference), but such pumps nonetheless still require seals with the inherent limitations described above. Check valves are less of a problem, because graphite seals can be used to seal the interior valve area and the seal is self-reinforcing with increasing dynamic pressure unlike with the seal between a piston and cylinder body. However, seals traditionally used around a piston in a piston pump have definite temperature limitations.

What is needed, therefore, is a pump design capable of operating at a wide range of temperatures including high temperatures (e.g., above 400° C.) without the limitations described above with conventional piston pump seals.

SUMMARY

The above and other needs are met by a reciprocating pump including a piston, a pump cavity, and a reservoir for collecting working fluid along the pump cavity wherein the pump does not utilize any seals along the piston of pump cavity, thereby allowing working fluid to escape a working chamber into the reservoir. This is useful in high temperature applications like the pumping of molten salt where seals would be destroyed by the high temperatures, and this application is also useful in lower temperature, hygienic applications in which the seals could degrade over time and the lubricant could leach into the working fluid, both causing contamination of the working fluid.

In a preferred embodiment, a reciprocating pump is disclosed, the pump comprising a pump shell including a pump shell first end and a pump shell second end; a pump cavity inside the pump shell, the pump cavity further comprising: a working chamber proximate to the pump shell second end; a drive chamber proximate to the pump shell first end; and a reservoir comprising a bulge in the pump cavity between the working chamber and the drive chamber for storing and accumulating working fluid. The reciprocating pump further comprises a suction pipe attached to the pump shell wherein the suction pipe is in fluid communication with the pump cavity; a suction valve situated along the suction pipe for selectively restricting flow of working fluid through the suction pipe; a delivery pipe attached to the pump shell wherein the delivery pipe is in fluid communication with the pump cavity; a delivery valve situated along the delivery pipe for selectively restricting flow of working fluid through the delivery pipe; a piston located inside the pump cavity and configured to alternate between a first position and a second position wherein such action is operable to draw working fluid through the suction pipe into the working chamber and then expel said working fluid out of the working chamber through the delivery pipe; a drive system engaged with the piston for driving the piston inside the pump cavity; a return pipe in fluid communication with the reservoir and the suction pipe; a return pipe valve located along the return pipe for controlling flow of working fluid through the return pipe; a feed pipe in fluid communication with the reservoir and the delivery pipe; a feed pipe valve located along the feed pipe for controlling flow of working fluid through the feed pipe; a reservoir sensor for sensing a level of working fluid in the reservoir; and a control system in communication with the return pipe valve, the feed pipe valve, and the reservoir sensor wherein the control system is operable to: open the feed pipe valve if the level of working fluid in the reservoir goes below a preset threshold; and open the return pipe valve if the level of working fluid in the reservoir goes above a preset threshold. Preferably, the control system is also preferably operable to close the feed pipe valve if the level of working fluid goes above a preset threshold. Similarly, the control system is preferably operable to close the return pipe if the level of working fluid in the reservoir goes below a preset threshold.

In a preferred embodiment, the reciprocating pump does not include any seals in the pump cavity or along the piston such that some working fluid is permitted to escape the working chamber and move into the reservoir during operation of the reciprocating pump.

In one embodiment, the pump shell includes a first end and a second end and wherein the first end is open to ambient atmosphere.

In another embodiment, the pump shell includes a first end and a second end and wherein the first end is closed to the atmosphere.

In a preferred embodiment, the drive system comprises an electromagnetic driving unit and wherein the control system is operable to control the electromagnetic driving unit to cause the piston to move and alternate between the first position and the second position.

In a preferred embodiment in which the first end of the pump shell is closed to ambient atmosphere, the reciprocating pump further comprises a gas feed line in fluid communication with the drive chamber; a gas feed line valve located along the gas feed line for controlling flow of gas into the drive chamber; a gas release line in fluid communication with the drive chamber; a gas release line valve located along the gas release line for controlling flow of gas out of the drive chamber; a pressure sensor for sensing the pressure of gas inside the drive chamber; and the control system in communication with the gas feed line valve, the gas release line valve, and the pressure sensor wherein the control system is operable to: open the gas feed line valve if gas pressure inside the drive chamber is sensed by the pressure sensor to fall below a minimum threshold pressure; and open the gas release line valve if gas pressure inside the drive chamber is sensed by the pressure sensor to reach a maximum threshold pressure. The control system is preferably further operable to: close the gas feed line valve if gas pressure inside the drive chamber is sensed by the pressure sensor to go above a minimum threshold pressure; and close the gas release line valve if gas pressure inside the drive chamber is sensed by the pressure sensor to fall below a maximum threshold pressure. The operations of the control system are preferably operable to control the pressure of gas in the drive chamber to limit the amount of working fluid that escapes from the working chamber to the reservoir and to prevent the working fluid from entering the drive chamber.

In the various embodiments described above, the pump shell, the pump piston, the suction valve, and the delivery valve may be made of material comprising metal or metal alloy. Additionally or alternatively, in the various embodiments described above, the pump shell, the pump piston, the suction valve, and the delivery valve may be made of material comprising ceramic. Additionally or alternatively, in the various embodiments described above, the pump shell, the pump piston, the suction valve, and the delivery valve may be made of material comprising plastic.

In the various embodiments described above, the suction valve may comprise a first check valve and the delivery valve may comprise a second check valve.

In the various embodiments described above, the return pipe valve may comprise a first solenoid valve and the feed pipe valve may comprise a second solenoid valve.

In another aspect, a method of controlling the flow of working fluid being pumped through a reciprocating pump which uses no seals along a pump piston or pump cavity is disclosed. The method preferably comprises collecting working fluid in a reservoir of a reciprocating pump, the reciprocating pump comprising: a pump shell including a pump shell first end and a pump shell second end; a pump cavity inside the pump shell, the pump cavity further comprising: a working chamber proximate to the pump shell second end; a drive chamber proximate to the pump shell first end; and a reservoir comprising a bulge in the pump cavity between the working chamber and the drive chamber for storing and accumulating working fluid; a suction pipe attached to the pump shell wherein the suction pipe is in fluid communication with the pump cavity; a suction valve situated along the suction pipe for selectively restricting flow of working fluid through the suction pipe; a delivery pipe attached to the pump shell wherein the delivery pipe is in fluid communication with the pump cavity; a delivery valve situated along the delivery pipe for selectively restricting flow of working fluid through the delivery pipe; a piston located inside the pump cavity and configured to alternate between a first position and a second position wherein such action is operable to draw working fluid through the suction pipe into the working chamber and then expel said working fluid out of the working chamber through the delivery pipe; a drive system engaged with the piston for driving the piston inside the pump cavity; a return pipe in fluid communication with the reservoir and the suction pipe; a return pipe valve located along the return pipe for controlling flow of working fluid through the return pipe; a feed pipe in fluid communication with the reservoir and the delivery pipe; a feed pipe valve located along the feed pipe for controlling flow of working fluid through the feed pipe; a reservoir sensor for sensing a level of working fluid in the reservoir; and a control system in communication with the return pipe valve, the feed pipe valve, and the reservoir sensor wherein the control system is operable to: open the feed pipe valve if the level of working fluid in the reservoir goes below a preset threshold; and open the return pipe valve if the level of working fluid in the reservoir goes above a preset threshold. The method preferably further includes opening the feed pipe valve if the level of working fluid in the reservoir goes below the preset threshold in order to raise the level of working fluid in the reservoir. The method preferably further comprises opening the return pipe valve if the level of working fluid in the reservoir goes above the preset threshold in order to lower the level of working fluid in the reservoir.

In one embodiment of the method described above, the reciprocating pump further comprises: a gas feed line in fluid communication with the drive chamber; a gas feed line valve located along the gas feed line for controlling flow of gas into the drive chamber; a gas release line in fluid communication with the drive chamber; a gas release line valve located along the gas release line for controlling flow of gas out of the drive chamber; a pressure sensor for sensing the pressure of gas inside the drive chamber; and the control system in communication with the gas feed line valve, the gas release line valve, and the pressure sensor wherein the control system is operable to: open the gas feed line valve if the gas pressure inside the drive chamber is sensed by the pressure sensor to fall to a minimum threshold pressure; and open the gas release line valve if the gas pressure inside the drive chamber is sensed by the pressure sensor to reach to a maximum threshold pressure. In this embodiment, the method preferably further comprises maintaining the gas pressure inside the drive chamber at a pressure ranging from the minimum threshold pressure to the maximum threshold pressure in order to prevent working fluid from entering the drive chamber.

In the various methods described above, the working fluid may comprise a liquid. In the various methods described above, the working fluid may consist of a liquid. In the various methods described above, the working fluid may comprise a multi-phase mixture of liquid, gas, and solids. In the various methods described above, the working fluid may comprise molten salt. In the various methods described above, the working fluid may consist of molten salt.

In the various methods described above, the working fluid may have a temperature of greater than 100° C. In the various methods described above, the working fluid may have a temperature of greater than 400° C.

In another aspect, a method of priming a reciprocating pump which uses no seals along a pump piston or pump cavity is disclosed. The method preferably comprises providing a pump comprising: a pump shell including a pump shell first end and a pump shell second end; a pump cavity inside the pump shell, the pump cavity further comprising: a working chamber proximate to the pump shell second end; a drive chamber proximate to the pump shell first end; and a reservoir comprising a bulge in the pump cavity between the working chamber and the drive chamber for storing and accumulating working fluid; a suction pipe attached to the pump shell wherein the suction pipe is in fluid communication with the pump cavity; a suction valve situated along the suction pipe for selectively restricting flow of working fluid through the suction pipe; a delivery pipe attached to the pump shell wherein the delivery pipe is in fluid communication with the pump cavity; a delivery valve situated along the delivery pipe for selectively restricting flow of working fluid through the delivery pipe; a piston located inside the pump cavity and configured to alternate between a first position and a second position wherein such action is operable to draw working fluid through the suction pipe into the working chamber and then expel said working fluid out of the working chamber through the delivery pipe; a drive system engaged with the piston for driving the piston inside the pump cavity; a return pipe in fluid communication with the reservoir and the suction pipe; a return pipe valve located along the return pipe for controlling flow of working fluid through the return pipe; a feed pipe in fluid communication with the reservoir and the delivery pipe; a feed pipe valve located along the feed pipe for controlling flow of working fluid through the feed pipe; a reservoir sensor for sensing a level of working fluid in the reservoir; and a control system in communication with the return pipe valve, the feed pipe valve, and the reservoir sensor wherein the control system is operable to: open the feed pipe valve if the level of working fluid in the reservoir goes below a preset threshold; and open the return pipe valve if the level of working fluid in the reservoir goes above a preset threshold. The method preferably further comprises filling the reservoir with working fluid. The method preferably further comprises activating the drive system to begin moving the piston so that the piston alternates between the first position to the second position and working fluid seeps into the working chamber to prime the reciprocating pump.

The summary provided herein is intended to provide examples of particular disclosed embodiments and is not intended to cover all potential embodiments or combinations of embodiments. Therefore, this summary is not intended to limit the scope of the invention disclosure in any way, a function which is reserved for the appended claims.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

The figures are provided to illustrate concepts of the invention disclosure and are not intended to embody all potential embodiments of the invention. Therefore, the figures are not intended to limit the scope of the invention disclosure in any way, a function which is reserved for the appended claims.

DETAILED DESCRIPTION

Generally disclosed herein is a reciprocating pump and method of using such reciprocating pump. Typically, seals made of rubber or polymeric materials are used on or adjacent to pistons in reciprocating pumps. Seals are an important feature to prevent working fluid in a pump cavity from seeping past a piston into a drive chamber of such pump. However, some applications require the pumping of very hot fluids such as, for example, molten salt. Temperatures of molten salt can easily reach over 400° C. In such applications, seals made of rubber and polymeric materials would fail due to the high temperatures involved. Using a reciprocating pump without seals along or adjacent to pump pistons would result in leakage of working fluid into a drive chamber. Therefore, using a reciprocating pump without such seals is counterintuitive because such seals are seen as a necessary part of reciprocating pumps for their proper function. This disclosure describes a counterintuitive solution to the problems discussed above.

Figure 1:
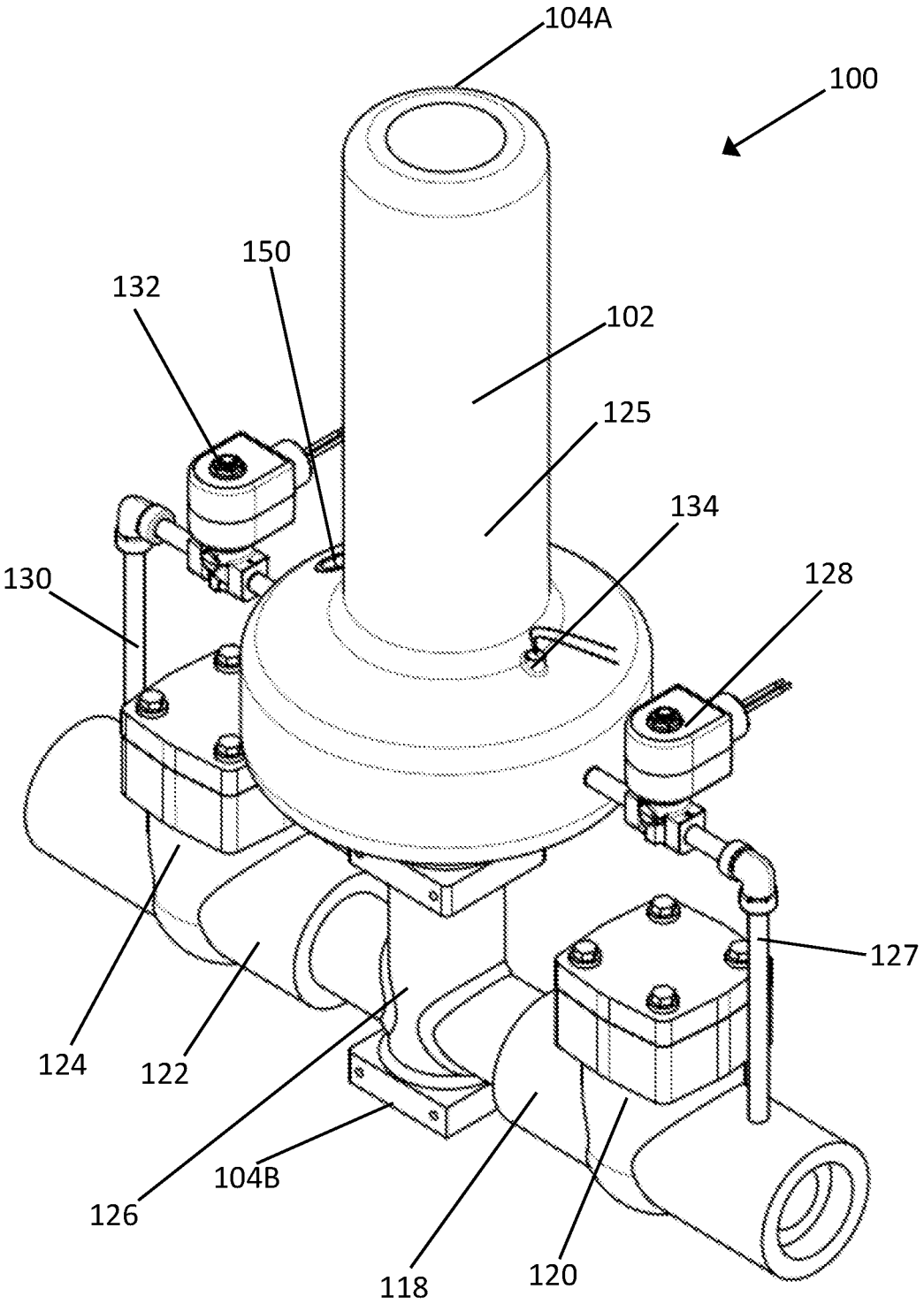
FIG. 1 shows a perspective view of a first embodiment of a reciprocating pump.
Figure 2:
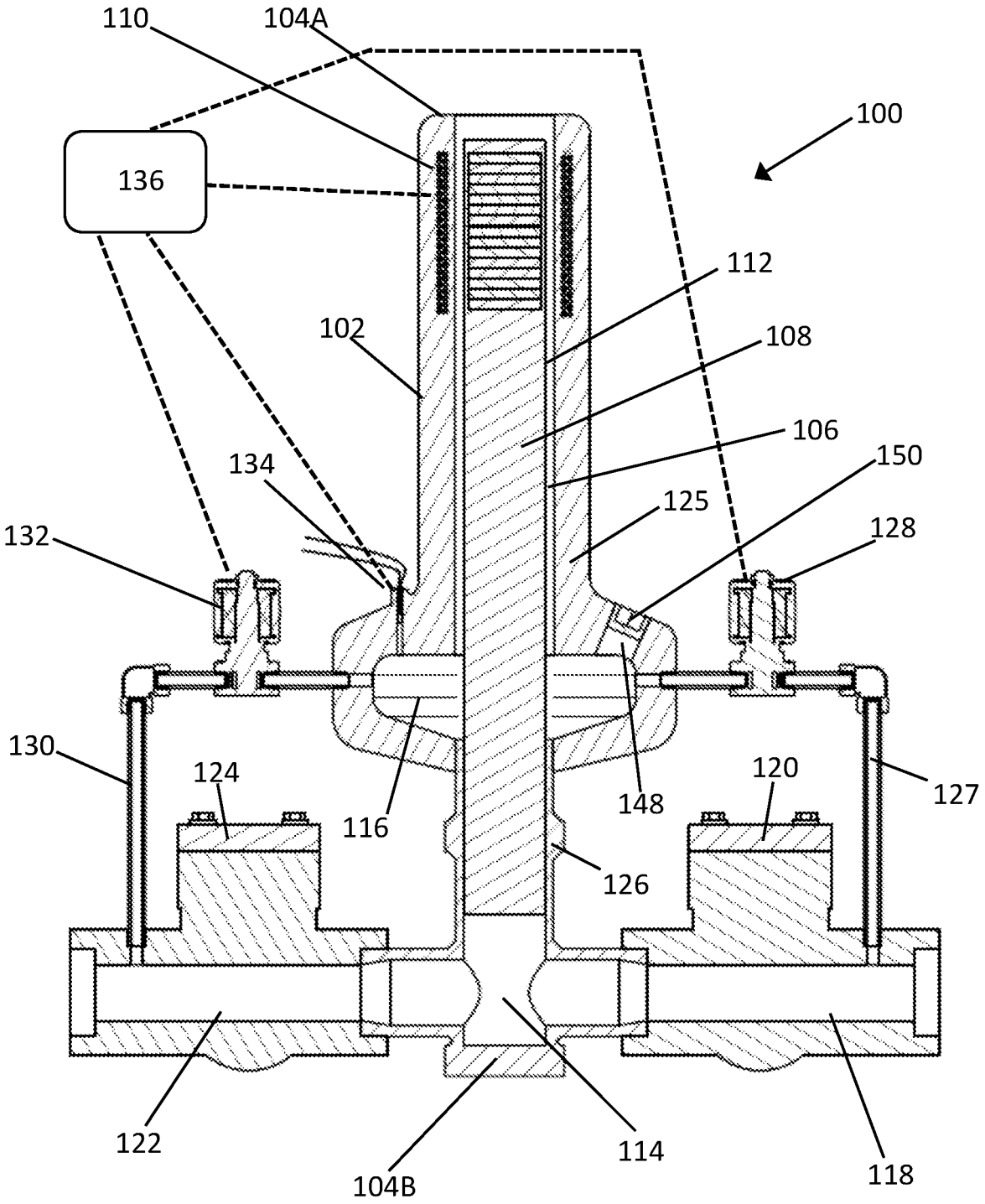
FIG. 2 shows a cross-sectional cutaway view of the reciprocating pump shown in FIG. 1 with a piston positioned in a first position.
Figure 3:
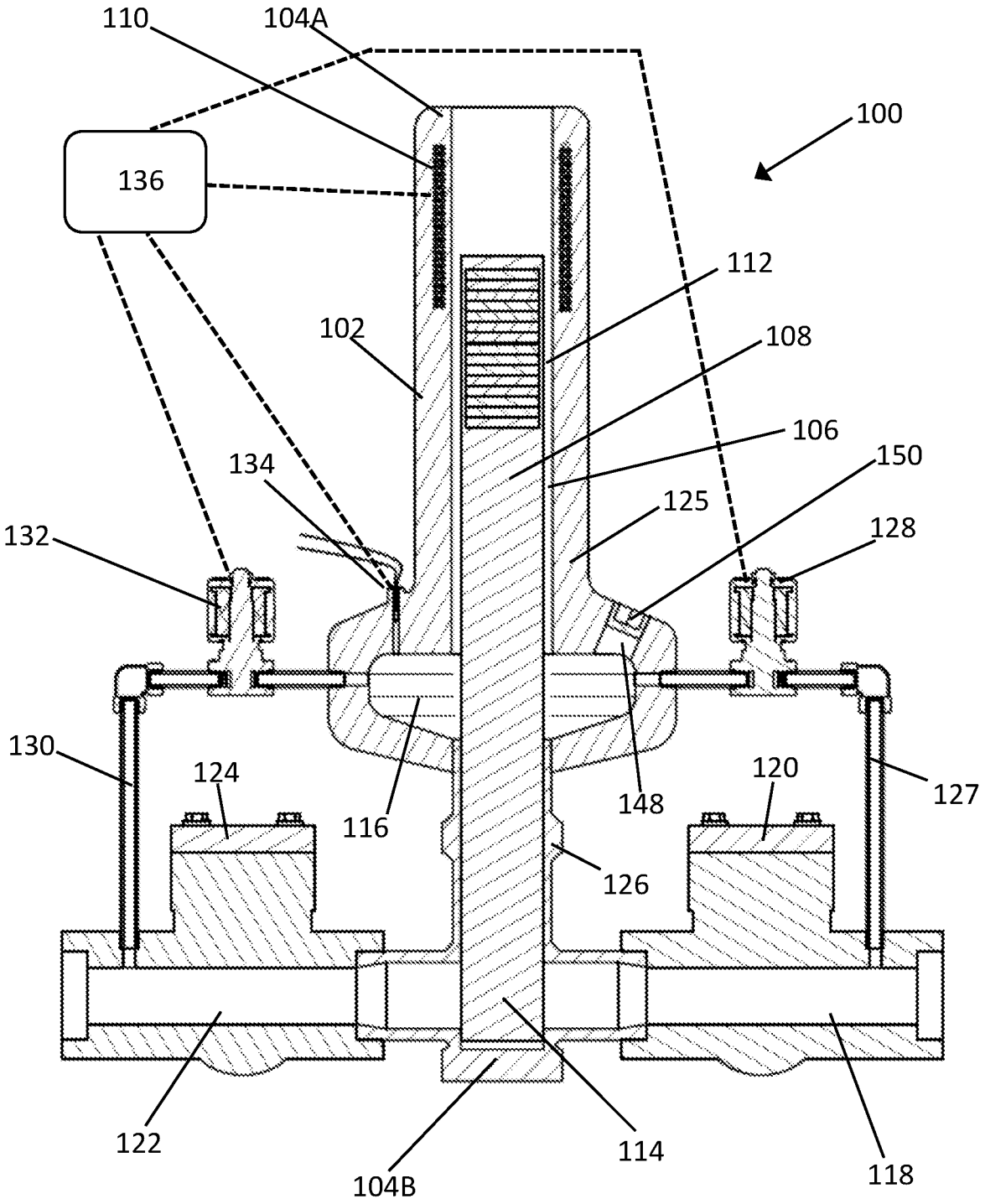
FIG. 3 shows the reciprocating pump shown in FIG. 2 with the piston positioned in a second position.

FIGS. 1-3 show a first embodiment of a reciprocating pump 100 including a pump shell 102 having a pump shell first end 104A and a pump shell second end 104B, a pump cavity 106, a piston 108, and a drive system 110 for driving the piston 108 to alternate between a first position shown in FIG. 2 and a second position shown in FIG. 3. The drive system 110 is either mechanically and/or electromagnetically engaged with the piston 108 to drive the piston 108. Importantly, the reciprocating pump 100 does not include any seals along the piston 108 or the pump cavity 106. The pump shell first end 104A of the reciprocating pump 100 is open to ambient atmosphere as shown in FIG. 1. The pump cavity 104 further includes a drive chamber 112 located proximate to the pump shell first end 104A, a working chamber 114 located proximate to the pump shell second end 104B, and a reservoir 116 which is effectively a bulge in the pump cavity 106 between drive chamber 112 and the working chamber 114. The reservoir 116 is preferably shaped as an annular ring. The drive chamber 112 and the working chamber 114 are preferably cylindrical in shape. Similarly, the piston 108 is preferably cylindrical in shape. The movement of the piston 108 causes working fluid to be drawn through a suction pipe 118 including a suction valve 120 into the working chamber 114 (with the delivery valve 124 closed) and then expel said working fluid out of the working chamber 114 through a delivery pipe 122 including a delivery valve 124 (with the suction valve 120 closed). The suction valve 120 and the delivery valve 124 are preferably mechanical check valves. Although check values are specified here, other types of valves may be used. In some embodiments, the reciprocating pump 100 pump shell 102 is formed of two parts including a first shell member 125 and a second shell member 126. The second shell member 126 often is a "T" shaped member, to which the suction pipe 118 and the delivery pipe 122 are attached, preferably by welding. In such embodiments, the working chamber 114 is typically located inside the second shell member 126. The first shell member 125 and the second shell member 126 are attached together, preferably by welding.

The drive system 110 preferably includes an electromagnetic driving unit such as the one described in U.S. Patent Application Publication Number 2017/0268491 entitled "Fluid Pump" to Ho, or the one described in U.S. Pat. No. 3,740,171 entitled "Electromagnetic Pump or Motor Device" to Farkos, the entire contents and teachings of which are incorporated herein by reference in their entireties. Although an electromagnetic drive system is shown in the figures, other drive systems are contemplated and could be used or adapted to work as a part of the reciprocating pump 100. For example, mechanical drive systems such as that described in U.S. Pat. No. 5,403,169 entitled "Plunger Pump" to Yokoi et al., can be used. The entire contents and teachings of this reference is incorporated herein by reference. A mechanical crank with one or more connecting rods may also be used as the drive system 110.

The reciprocating pump 100 preferably further includes a return pipe 127 in fluid communication with the reservoir 116 and the suction pipe 118. A return pipe valve 128 located along the return pipe 127 is used for controlling flow of working fluid through the return pipe 127. The reciprocating pump 100 further includes a feed pipe 130 in fluid communication with the reservoir 116 and the delivery pipe 122. A feed pipe valve 132 located along the feed pipe 130 is used for controlling flow of working fluid through the feed pipe 130.

The reciprocating pump 100 preferably further includes a reservoir sensor 134 for sensing a level of working fluid in the reservoir 116. The reciprocating pump 100 preferably further includes a control system 136 in communication with the reservoir sensor 134, the return pipe valve 128, and the feed pipe valve 132. The control system 136 may include a classic programmable logic controller (PLC), a computer or computers including one or more processors, a custom electronic printed circuit board (PCB), or other control device known to persons having ordinary skill in the art. The control system 136 may be in communication with an electromagnetic drive as shown in the figures. The control system 136 may be connected to these components using wires, through a wireless connection, or combinations thereof. The control system 136 is preferably operable to open the feed pipe valve 132 if the level of working fluid in the reservoir 116 reaches or goes below a preset threshold; and/or open the return pipe valve 128 if the level of working fluid in the reservoir 116 reaches or goes above a preset threshold. The control system 136 is also preferably operable to close the feed pipe valve 132 if the level of working fluid goes above a preset threshold. Similarly, the control system 136 is operable to close the return pipe valve 128 if the level of working fluid in the reservoir 116 goes below a preset threshold. In a preferred embodiment, the control system 136 can be configured to make sure that the feed pipe valve 132 and the return pipe valve 128 are not open at the same time. The level of working fluid is indicated by the reservoir sensor 134 with data fed to the control system 136. Pressure created by action of the piston 108 helps to force working fluid through the feed pipe 130 into the reservoir 116 when the feed pipe valve 132 is open. The return pipe valve 128 and the feed pipe valve 132 are preferably solenoid valves, but other types of computer-controlled valves known to persons having ordinary skill in the art may be used.

Figure 4:
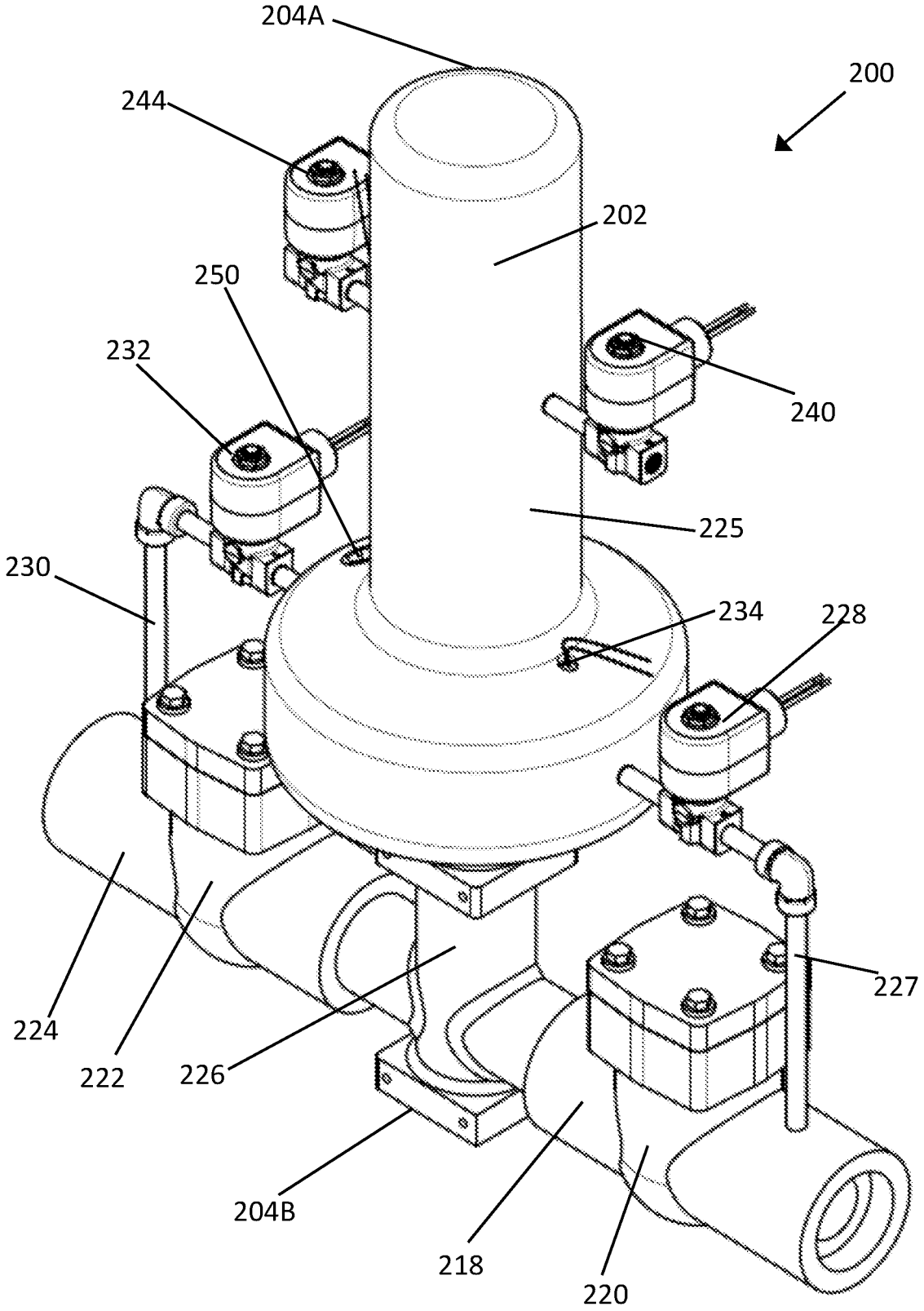
FIG. 4 shows a perspective view of a second embodiment of a reciprocating pump.
Figure 5:
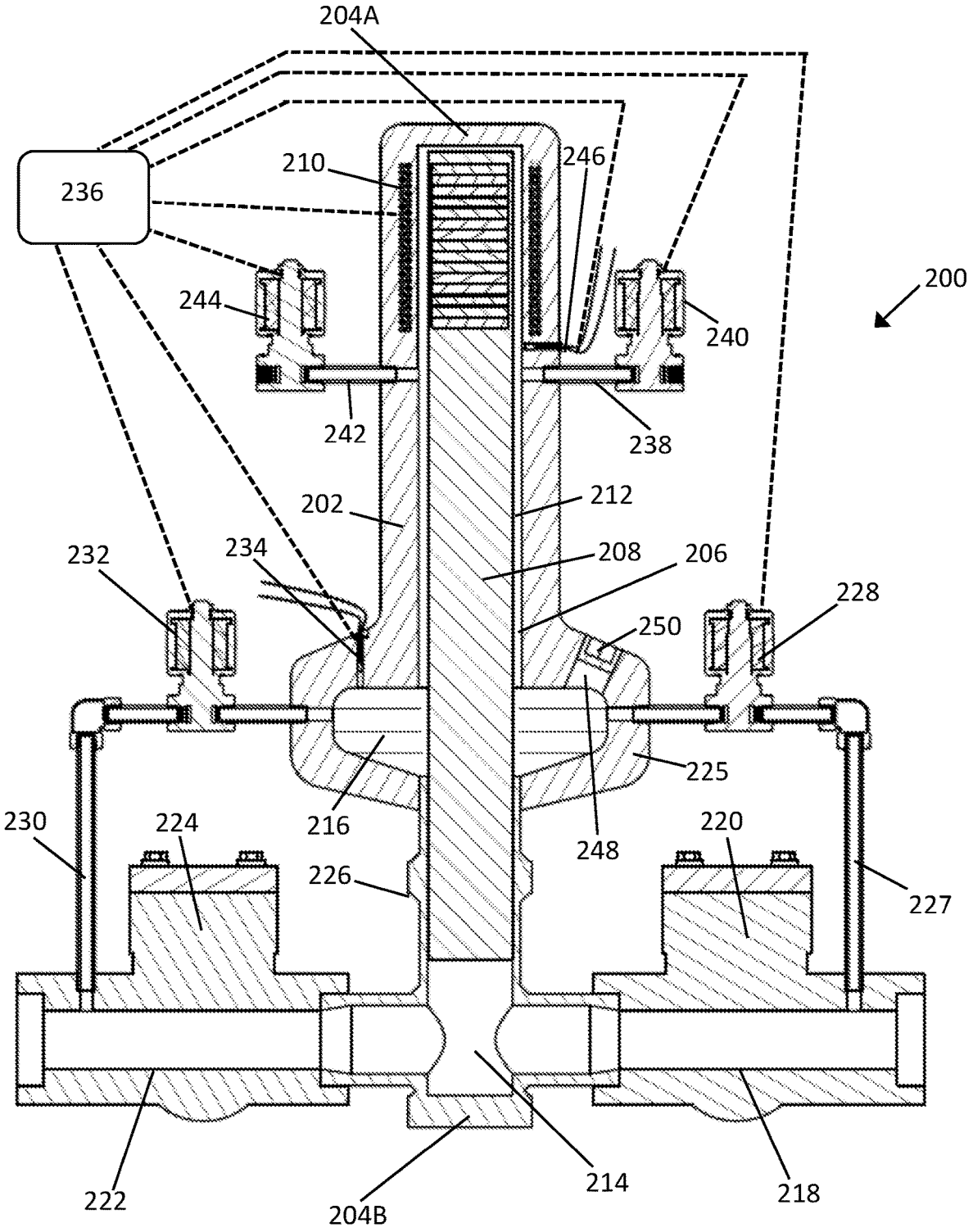
FIG. 5 shows a cross-sectional cutaway view of the reciprocating pump shown in FIG. 4 with a piston positioned in a first position.
Figure 6:
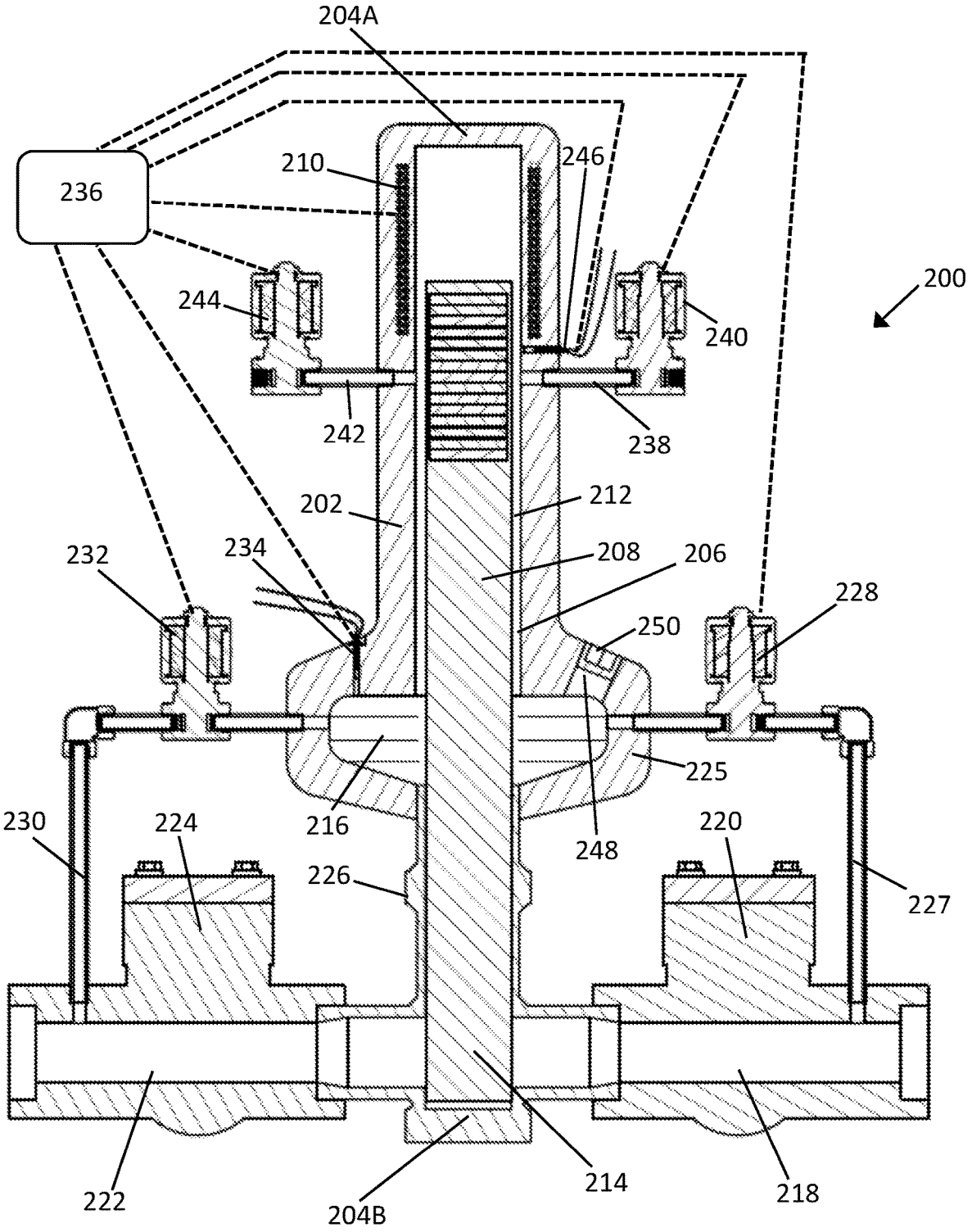
FIG. 6 shows the reciprocating pump shown in FIG. 5 with the piston positioned in a second position.

FIGS. 4-6 show a second embodiment of a reciprocating pump 200 including a pump shell 202 having a pump shell first end 204A and a pump shell second end 204B, a pump cavity 206, a piston 208, and a drive system 210 for driving the piston 208 to alternate between a first position shown in FIG. 5 and a second position shown in FIG. 6. The drive system 210 is either mechanically and/or electromagnetically engaged with the piston 208 to drive the piston 208. Importantly, the reciprocating pump 200 does not include any seals along the piston 208 or the pump cavity 206. Unlike the pump shell 102 shown in FIGS. 1-3, the pump shell first end 204A of the reciprocating pump 200 shown in FIGS. 4-6 is closed to ambient atmosphere as shown in FIG. 4. The pump cavity 204 further includes a drive chamber 212 located proximate to the pump shell first end 204A, a working chamber 214 located proximate to the pump shell second end 204B, and a reservoir 216 which is effectively a bulge in the pump cavity 206 between drive chamber 212 and the working chamber 214. The reservoir 216 is preferably shaped as an annular ring. The drive chamber 212 and the working chamber 214 are preferably cylindrical in shape. Similarly, the piston 208 is preferably cylindrical in shape. The movement of the piston 208 causes working fluid to be drawn through a suction pipe 218 including a suction valve 220 into the working chamber 214 (with the delivery valve 224 closed) and then expel said working fluid out of the working chamber 214 through a delivery pipe 222 including a delivery valve 224 (with the suction valve 220 closed). The suction valve 220 and the delivery valve 224 are preferably mechanical check valves. Although check values are specified here, other types of valves may be used. In some embodiments, the reciprocating pump 200 pump shell 202 is formed of two parts including a first shell member 225 and a second shell member 226. The second shell member 226 often is a "T" shaped member, to which the suction pipe 218 and the delivery pipe 222 are attached, preferably by welding. In such embodiments, the working chamber 214 is typically located inside the second shell member 226. The first shell member 225 and the second shell member 226 are attached together, preferably by welding.

The drive system 210 preferably includes an electromagnetic driving unit such as the one described in U.S. Patent Application Publication Number 2017/0268491 entitled "Fluid Pump" to Ho, or the one described in U.S. Pat. No. 3,740,171 entitled "Electromagnetic Pump or Motor Device" to Farkos, the entire contents and teachings of which are incorporated herein by reference in their entireties. Although an electromagnetic drive system is shown in the figures, other drive systems are contemplated and could be used or adapted to work as a part of the reciprocating pump 200. For example, mechanical drive systems such as that described in U.S. Pat. No. 5,403,169 entitled "Plunger Pump" to Yokoi et al., can be used. The entire contents and teachings of this reference is incorporated herein by reference. A mechanical crank with one or more connecting rods may also be used as the drive system 210.

The reciprocating pump 200 preferably further includes a return pipe 227 in fluid communication with the reservoir 216 and the suction pipe 218. A return pipe valve 228 located along the return pipe 227 is used for controlling flow of working fluid through the return pipe 227. The reciprocating pump 200 further includes a feed pipe 230 in fluid communication with the reservoir 216 and the delivery pipe 222. A feed pipe valve 232 located along the feed pipe 230 is used for controlling flow of working fluid through the feed pipe 230.

The reciprocating pump 200 preferably further includes a reservoir sensor 234 for sensing a level of working fluid in the reservoir 216. The reciprocating pump 200 preferably further includes a control system 236 in communication with the reservoir sensor 234, the return pipe valve 228, and the feed pipe valve 232. The control system 236 may include a classic programmable logic controller (PLC), a computer or computers including one or more processors, a custom electronic printed circuit board (PCB), or other control device known to persons having ordinary skill in the art. The control system 136 may be in communication with an electromagnetic drive as shown in the figures. The control system 236 may be connected to these components using wires, through a wireless connection, or combinations thereof. The control system 236 is preferably operable to open the feed pipe valve 232 if the level of working fluid in the reservoir 216 goes below a preset threshold; and/or open the return pipe valve 228 if the level of working fluid in the reservoir 216 goes above a preset threshold. The control system 236 is also preferably operable to close the feed pipe valve 232 if the level of working fluid goes above a preset threshold. Similarly, the control system 236 is operable to close the return pipe valve 228 if the level of working fluid in the reservoir 216 goes below a preset threshold. In a preferred embodiment, the control system 236 can be configured to make sure that the feed pipe valve 232 and the return pipe valve 228 are not open at the same time. The level of working fluid is indicated by the reservoir sensor 234 with data fed to the control system 236. Pressure created by action of the piston 208 helps to force working fluid through the feed pipe 230 into the reservoir 216 when the feed pipe valve 232 is open. The return pipe valve 228 and the feed pipe valve 232 are preferably solenoid valves, but other types of computer-controlled valves known to persons having ordinary skill in the art may be used.

An important feature of the reciprocating pump 200 shown in FIGS. 4-6 is the fact that the pump shell first end 204A is closed such that the drive chamber 212 can be pressurized with a gas. By adding gas to the drive chamber 212 and controlled gas pressure in the drive chamber 212, such pressurization can operate to prevent working fluid from leaking past the reservoir 216 into the drive chamber 212. The gas(es) used preferably include one or more inert gases such as, for example, argon gas. The features for controlling gas pressure in the drive chamber 212 are described in more detail below.

The reciprocating pump 200 shown in FIGS. 4-6 preferably further includes a gas feed line 238 in fluid communication with the drive chamber 212, a gas feed line valve 240 located along the gas feed line 238 for controlling flow of gas into the drive chamber 212, a gas release line 242 in fluid communication with the drive chamber 212, a gas release line valve 244 located along the gas release line 242 for controlling flow of gas out of the drive chamber 212, and a pressure sensor 246 for sensing the pressure of gas inside the drive chamber 212. The control system 236 is in communication with the gas feed line valve 240, the gas release line valve 244, and the pressure sensor 246. The control system 236 may be connected to these components using wires, through a wireless connection, or combinations thereof. The control system 236 is preferably further operable to open the gas feed line valve 240 if gas pressure inside the drive chamber 212 is sensed by the pressure sensor 246 to reach or fall below a minimum threshold pressure; and/or open the gas release line valve 244 if gas pressure inside the drive chamber 212 is sensed by the pressure sensor 246 to reach or exceed a maximum threshold pressure. The control system 236 is preferably further operable to close the gas feed line valve 240 if gas pressure inside the drive chamber 212 is sensed by the pressure sensor 246 to go above a minimum threshold pressure; and/or close the gas release line valve 244 if gas pressure inside the drive chamber 212 is sensed by the pressure sensor 246 to fall below a maximum threshold pressure. In a preferred embodiment, the control system 236 can be configured to ensure that the gas feed line valve 240 and the gas release line valve 244 are not open at the same time.

The various components of the reciprocating pumps described above are preferably made of metal, metal alloy, and/or ceramic material for high temperature applications (e.g., pumping molten salt). The sizes and exact shapes of the components in the reciprocating pumps described above may vary. Alternatively, for lower temperature applications (i.e., less than 100° C.) such as hygienic applications, polymeric materials can be used (e.g., plastic).

Figure 7:
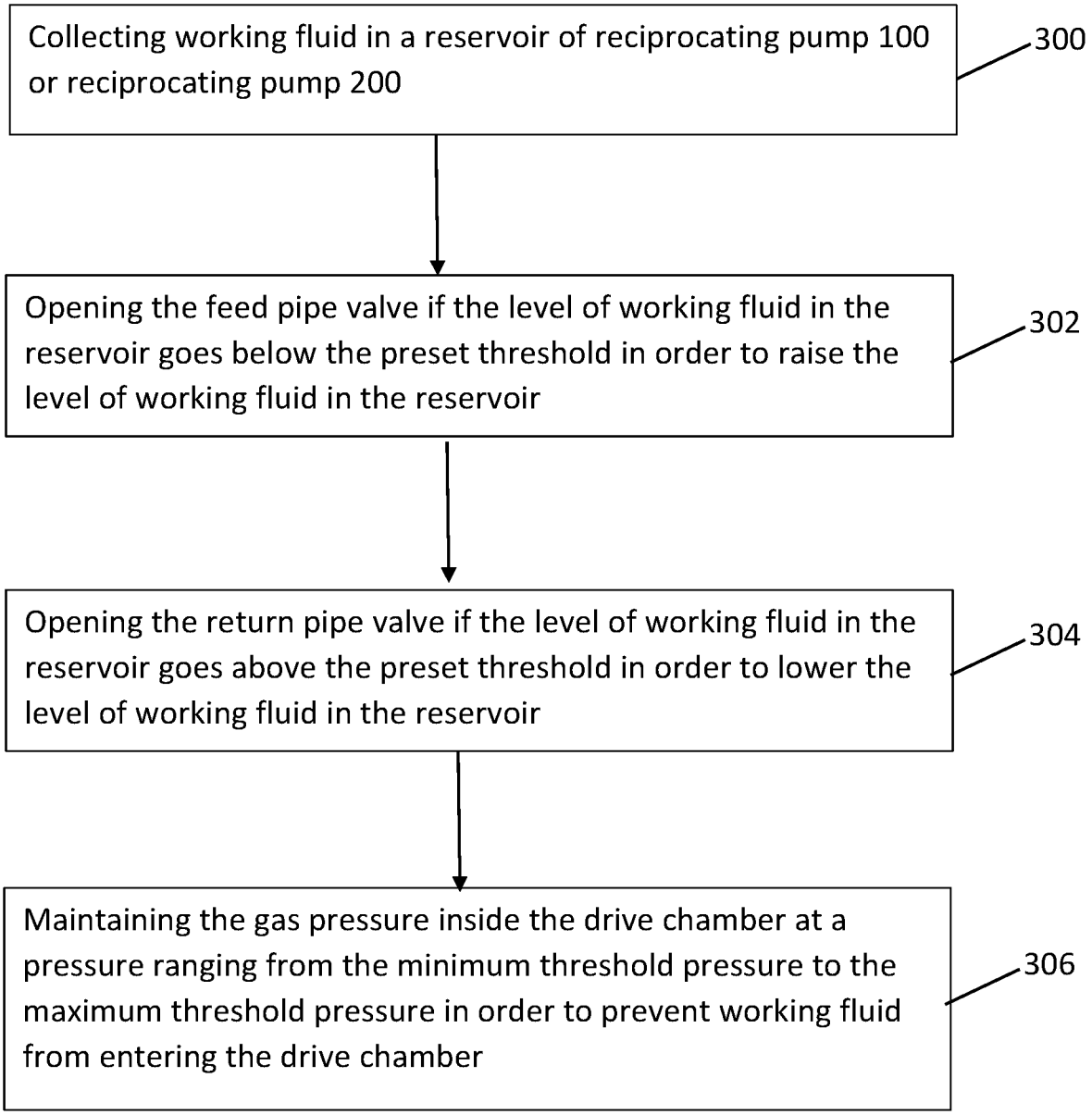
FIG. 7 shows operations of a method of controlling the flow of working fluid being pumped through a reciprocating pump which uses no seals along a pump piston or pump cavity.

In addition to the reciprocating pump 100 and the reciprocating pump 200 described above, a method of controlling the flow of working fluid being pumped through a reciprocating pump which uses no seals along a pump piston or pump cavity is disclosed as shown in FIG. 7. Either the reciprocating pump 100 or the reciprocating pump 200 can be used for the initial operations including 300 collecting working fluid in a reservoir of the reciprocating pump; 302 opening the feed pipe valve if the level of working fluid in the reservoir goes below the preset threshold in order to raise the level of working fluid in the reservoir; and 304 opening the return pipe valve if the level of working fluid in the reservoir goes above the preset threshold in order to lower the level of working fluid in the reservoir. For the following operation, the reciprocating pump 200 would need to be used, the additional operations including 306 maintaining the gas pressure inside the drive chamber at a pressure ranging from the minimum threshold pressure to the maximum threshold pressure in order to prevent working fluid from entering the drive chamber.

Figure 8:
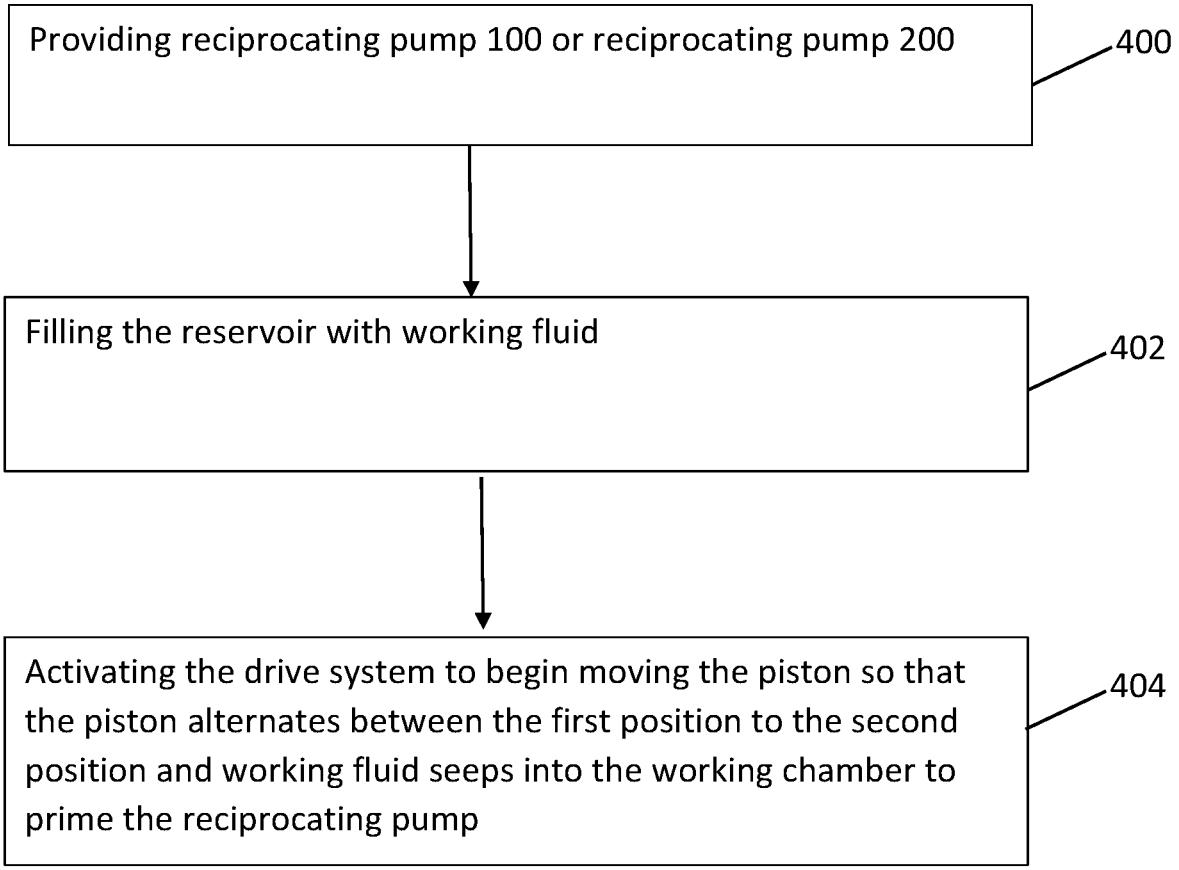
FIG. 8 shows operations of a method of priming a reciprocating pump which uses no seals along a pump piston or pump cavity.

An additional method of priming a reciprocating pump which uses no seals along a pump piston or pump cavity is also disclosed as shown in FIG. 8. For this method either the reciprocating pump 100 or the reciprocating pump 200 may be used. The method includes 400 providing a reciprocating pump; 402 filling the reservoir with working fluid; and 404 activating the drive system to begin moving the piston so that the piston alternates between the first position to the second position and working fluid seeps into the working chamber to prime the reciprocating pump. Operation 402 if filling the reservoir with working fluid may be accomplished by filling material into the reservoir (116 or 216) through an access port (148 or 248) wherein the access port can be closed using a removable plug (150 or 250). For high temperature applications, salt can be added through the access port (148 or 248) which will later become molten when the temperature of the system reaches a certain level.

Embodiments in the disclosure are particularly well-suited for use at high temperatures (e.g., above 400° C.). One application for using embodiments described herein is pumping molten salt which must be kept at a high temperature. Other applications are contemplated which could require use at low or high temperatures. The previously described embodiments of the present disclosure have many advantages, including providing a way to pump high temperature fluids without the drawback of destroying pump seals due to the high temperature. Another advantage to the reciprocating pump 200 is that working fluid can be prevented from entering the drive chamber 212 by exerting high pressure gas in the drive chamber 212 to counter any tendency of working fluid to creep toward the drive chamber 212. Also, by providing a reservoir and allowing working fluid to extend into space between the piston and the pump shell, the working fluid works as a partial seal. Additionally, working fluid the is initially placed in the reservoir can be used as a pump priming agent as working fluid leaves the reservoir and extends into space between the piston and the pump shell when the drive system is activated.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

Any element in a claim that does not explicitly state "means for" performing a specified function, or "step for" performing a specific function, is not to be interpreted as a "means" or "step" clause as specified in 35 U.S.C. § 112, ¶6. In particular, the use of "step of" in the claims herein is not intended to invoke the provisions of 35 U.S.C. § 112, ¶6.

What is claimed is:

1. A reciprocating pump comprising:

a pump shell including a pump shell first end and a pump shell second end;

a pump cavity inside the pump shell, the pump cavity further comprising:

a working chamber proximate to the pump shell second end;

a drive chamber proximate to the pump shell first end; and a reservoir comprising a bulge in the pump cavity between the working chamber and the drive chamber for storing and accumulating a working fluid;

a suction pipe attached to the pump shell wherein the suction pipe is in fluid communication with the pump cavity;

a suction valve situated along the suction pipe for selectively restricting flow of the working fluid through the suction pipe;

a delivery pipe attached to the pump shell wherein the delivery pipe is in fluid communication with the pump cavity;

a delivery valve situated along the delivery pipe for selectively restricting flow of the working fluid through the delivery pipe;

a piston located inside the pump cavity and configured to alternate between a first position and a second position wherein such action is operable to draw the working fluid through the suction pipe into the working chamber and then expel said working fluid out of the working chamber through the delivery pipe;

a drive system engaged with the piston for driving the piston inside the pump cavity;

a return pipe in fluid communication with the reservoir and the suction pipe;

a return pipe valve located along the return pipe for controlling flow of the working fluid through the return pipe;

a feed pipe in fluid communication with the reservoir and the delivery pipe;

a feed pipe valve located along the feed pipe for controlling flow of the working fluid through the feed pipe;

a reservoir sensor for sensing a level of the working fluid in the reservoir; and a control system in communication with the return pipe valve, the feed pipe valve, and the reservoir sensor wherein the control system is operable to:

open the feed pipe valve if the level of the working fluid in the reservoir goes below a preset threshold; and open the return pipe valve if the level of the working fluid in the reservoir goes above a preset threshold.

2. The reciprocating pump of claim 1 wherein the reciprocating pump does not include any seals in the pump cavity or along the piston such that some of the working fluid is permitted to escape the working chamber and move into the reservoir during operation of the reciprocating pump.

3. The reciprocating pump of claim 1 wherein the pump shell first end is open to ambient atmosphere.

4. The reciprocating pump of claim 1 wherein the pump shell first end is closed to the atmosphere.

5. The reciprocating pump of claim 4 further comprising:

a gas feed line in fluid communication with the drive chamber;

a gas feed line valve located along the gas feed line for controlling flow of gas into the drive chamber;

a gas release line in fluid communication with the drive chamber;

a gas release line valve located along the gas release line for controlling flow of gas out of the drive chamber;

a pressure sensor for sensing the pressure of gas inside the drive chamber; and the control system in communication with the gas feed line valve, the gas release line valve, and the pressure sensor wherein the control system is operable to:

open the gas feed line valve if gas pressure inside the drive chamber is sensed by the pressure sensor to fall below a minimum threshold pressure; and open the gas release line valve if gas pressure inside the drive chamber is sensed by the pressure sensor to reach a maximum threshold pressure.

6. The reciprocating pump of claim 5 wherein the operations of the control system are operable to control the pressure of gas in the drive chamber to limit an amount of the working fluid that escapes from the working chamber to the reservoir and to prevent the working fluid from entering the drive chamber.

7. The reciprocating pump of claim 1 wherein the drive system comprises an electromagnetic driving unit and wherein the control system is operable to control the electromagnetic driving unit to cause the piston to move and alternate between the first position and the second position.

8. The reciprocating pump of claim 1 wherein the pump shell, the pump piston, the suction valve, and the delivery valve are made of material comprising metal or metal alloy.

9. The reciprocating pump of claim 1 wherein the pump shell, the pump piston, the suction valve, and the delivery valve are made of material comprising ceramic.

10. The reciprocating pump of claim 1 wherein the pump shell, the pump piston, the suction valve, and the delivery valve are made of material comprising plastic.

11. The reciprocating pump of claim 1 wherein the suction valve comprises a first check valve and the delivery valve comprises a second check valve.

12. The reciprocating pump of claim 1 wherein the return pipe valve comprises a first solenoid valve and wherein the feed pipe valve comprises a second solenoid valve.

13. A method of controlling a flow of a working fluid being pumped through a reciprocating pump which uses no seals along a pump piston or pump cavity, the method comprising:

collecting the working fluid in a reservoir of a reciprocating pump, the reciprocating pump comprising:

a pump shell including a pump shell first end and a pump shell second end;

a pump cavity inside the pump shell, the pump cavity further comprising:

a working chamber proximate to the pump shell second end;

a drive chamber proximate to the pump shell first end; and a reservoir comprising a bulge in the pump cavity between the working chamber and the drive chamber for storing and accumulating the working fluid;

a suction pipe attached to the pump shell wherein the suction pipe is in fluid communication with the pump cavity;

a suction valve situated along the suction pipe for selectively restricting flow of the working fluid through the suction pipe;

a delivery pipe attached to the pump shell wherein the delivery pipe is in fluid communication with the pump cavity;

a delivery valve situated along the delivery pipe for selectively restricting flow of the working fluid through the delivery pipe;

a piston located inside the pump cavity and configured to alternate between a first position and a second position wherein such action is operable to draw the working fluid through the suction pipe into the working chamber and then expel said working fluid out of the working chamber through the delivery pipe;

a drive system engaged with the piston for driving the piston inside the pump cavity;

a return pipe in fluid communication with the reservoir and the suction pipe;

a return pipe valve located along the return pipe for controlling flow of the working fluid through the return pipe;

a feed pipe in fluid communication with the reservoir and the delivery pipe;

a feed pipe valve located along the feed pipe for controlling flow of the working fluid through the feed pipe;

a reservoir sensor for sensing a level of the working fluid in the reservoir; and a control system in communication with the return pipe valve, the feed pipe valve, and the reservoir sensor wherein the control system is operable to:

open the feed pipe valve if the level of the working fluid in the reservoir goes below a preset threshold; and open the return pipe valve if the level of the working fluid in the reservoir goes above a preset threshold;

opening the feed pipe valve if the level of the working fluid in the reservoir goes below the preset threshold in order to raise the level of the working fluid in the reservoir; and opening the return pipe valve if the level of working fluid in the reservoir goes above the preset threshold in order to lower the level of the working fluid in the reservoir.

14. The method of claim 13 wherein the reciprocating pump further comprises:

a gas feed line in fluid communication with the drive chamber;

a gas feed line valve located along the gas feed line for controlling flow of gas into the drive chamber;

a gas release line in fluid communication with the drive chamber;

a gas release line valve located along the gas release line for controlling flow of gas out of the drive chamber;

a pressure sensor for sensing the pressure of gas inside the drive chamber; and the control system in communication with the gas feed line valve, the gas release line valve, and the pressure sensor wherein the control system is operable to:

open the gas feed line valve if the gas pressure inside the drive chamber is sensed by the pressure sensor to fall to a minimum threshold pressure; and open the gas release line valve if the gas pressure inside the drive chamber is sensed by the pressure sensor to reach to a maximum threshold pressure; and wherein the method further comprises operations of:

maintaining the gas pressure inside the drive chamber at a pressure ranging from the minimum threshold pressure to the maximum threshold pressure in order to prevent the working fluid from entering the drive chamber.

15. The method of claim 14 wherein the working fluid comprises a liquid.

16. The method of claim 14 wherein the working fluid consists of a liquid.

17. The method of claim 14 wherein the working fluid comprises a multi-phase mixture of liquid, gas, and solids.

18. The method of claim 14 wherein the working fluid comprises molten salt.

19. The method of claim 14 wherein the working fluid consists of molten salt.

20. The method of claim 14 wherein the working fluid has a temperature of greater than 100° C.

21. The method of claim 14 wherein the working fluid has a temperature of greater than 400° C.

22. The method of claim 13 wherein the working fluid comprises a liquid.

23. The method of claim 13 wherein the working fluid consists of a liquid.

24. The method of claim 13 wherein the working fluid comprises a multi-phase mixture of liquid, gas, and solids.

25. The method of claim 13 wherein the working fluid comprises molten salt.

26. The method of claim 13 wherein the working fluid consists of molten salt.

27. The method of claim 13 wherein the working fluid has a temperature of greater than 100° C.

28. The method of claim 13 wherein the working fluid has a temperature of greater than 400° C.

29. A method of priming a reciprocating pump which uses no seals along a pump piston or pump cavity, the method comprising:

providing a pump comprising:

a pump shell including a pump shell first end and a pump shell second end;

a pump cavity inside the pump shell, the pump cavity further comprising:

a working chamber proximate to the pump shell second end;

a drive chamber proximate to the pump shell first end; and a reservoir comprising a bulge in the pump cavity between the working chamber and the drive chamber for storing and accumulating a working fluid;

a suction pipe attached to the pump shell wherein the suction pipe is in fluid communication with the pump cavity;

a suction valve situated along the suction pipe for selectively restricting flow of the working fluid through the suction pipe;

a delivery pipe attached to the pump shell wherein the delivery pipe is in fluid communication with the pump cavity;

a delivery valve situated along the delivery pipe for selectively restricting flow of the working fluid through the delivery pipe;

a piston located inside the pump cavity and configured to alternate between a first position and a second position wherein such action is operable to draw the working fluid through the suction pipe into the working chamber and then expel said working fluid out of the working chamber through the delivery pipe;

a drive system engaged with the piston for driving the piston inside the pump cavity;

a return pipe in fluid communication with the reservoir and the suction pipe;

a return pipe valve located along the return pipe for controlling flow of the working fluid through the return pipe;

a feed pipe in fluid communication with the reservoir and the delivery pipe;

a feed pipe valve located along the feed pipe for controlling flow of the working fluid through the feed pipe;

a reservoir sensor for sensing a level of the working fluid in the reservoir; and a control system in communication with the return pipe valve, the feed pipe valve, and the reservoir sensor wherein the control system is operable to:

open the feed pipe valve if the level of the working fluid in the reservoir goes below a preset threshold; and open the return pipe valve if the level of the working fluid in the reservoir goes above a preset threshold;

filling the reservoir with the working fluid; and activating the drive system to begin moving the piston so that the piston alternates between the first position to the second position and the working fluid seeps into the working chamber to prime the reciprocating pump.

* * * * *